US008136897B2

(12) United States Patent
Mascari

(10) Patent No.: US 8,136,897 B2
(45) Date of Patent: Mar. 20, 2012

(54) OVERHEAD STORAGE SYSTEM HAVING TELESCOPIC STORAGE CONTAINER

(76) Inventor: Mark L Mascari, Harrisburg, PA (US)

( * ) Notice: Subject to any disclaimer, the term of this patent is extended or adjusted under 35 U.S.C. 154(b) by 324 days.

(21) Appl. No.: 12/467,458

(22) Filed: May 18, 2009

(65) Prior Publication Data

US 2009/0284110 A1 Nov. 19, 2009

Related U.S. Application Data

(60) Provisional application No. 61/053,851, filed on May 16, 2008.

(51) Int. Cl.
*A47B 67/02* (2006.01)

(52) U.S. Cl. ..... 312/242; 312/248; 312/310; 312/322; 16/342

(58) Field of Classification Search ..... 312/242, 312/245–246, 248, 319.1–319.2, 310, 293.1–293.2, 312/322–323, 128, 132–133; 16/342
See application file for complete search history.

(56) References Cited

U.S. PATENT DOCUMENTS

| | | | | | |
|---|---|---|---|---|---|
| 1,345,194 | A * | 6/1920 | Johnson | 312/204 |
| 2,492,697 | A * | 12/1949 | Higley | 312/322 |
| 4,460,145 | A * | 7/1984 | Ando | 248/447 |
| 4,485,928 | A * | 12/1984 | Staashelm | 211/35 |
| 4,916,862 | A * | 4/1990 | Storer | 49/386 |
| 4,951,350 | A * | 8/1990 | Nunes | 16/263 |
| 5,238,358 | A * | 8/1993 | Higgins et al. | 414/463 |
| 5,407,261 | A | 4/1995 | Mercer | |
| 5,460,280 | A | 10/1995 | Feddeler | |
| 5,593,201 | A * | 1/1997 | Bateman | 296/100.02 |
| 5,954,410 | A | 9/1999 | Noellert | |
| 5,966,776 | A * | 10/1999 | Ona | 16/328 |
| 6,250,728 | B1 * | 6/2001 | Thorp | 312/247 |
| 6,331,026 | B1 * | 12/2001 | Adsit et al. | 296/37.7 |
| 6,381,808 | B1 * | 5/2002 | Kida | 16/340 |
| 6,446,308 | B1 * | 9/2002 | Brewington et al. | 16/337 |
| 6,550,878 | B2 * | 4/2003 | Nott et al. | 312/248 |
| 6,572,168 | B1 * | 6/2003 | Radstake | 312/247 |
| 6,634,061 | B1 * | 10/2003 | Maynard | 16/342 |
| 6,671,927 | B2 * | 1/2004 | Chen | 16/339 |
| 7,246,865 | B1 * | 7/2007 | Merrell, II | 312/248 |
| 7,837,170 | B2 * | 11/2010 | Behroozi | 248/317 |
| 2002/0042971 | A1 * | 4/2002 | Liao | 16/342 |
| 2002/0112319 | A1 * | 8/2002 | Kida | 16/342 |
| 2003/0046792 | A1 * | 3/2003 | Thorn et al. | 16/342 |
| 2005/0248241 | A1 * | 11/2005 | Ceglarski | 312/245 |
| 2006/0197419 | A1 * | 9/2006 | Sorensen | 312/245 |

* cited by examiner

*Primary Examiner* — Hanh V Tran
(74) *Attorney, Agent, or Firm* — James Ray & Assoc

(57) ABSTRACT

An overhead storage system for attachment to a ceiling includes a hollow housing, frame and a pair of pivots pivotally attaching a rear end of the frame to a rear end of the housing so that the frame pivots between a storage position wherein the frame is disposed generally coplanar with a ceiling surface and an access position wherein the frame is disposed at a predetermined angle relative to the ceiling surface. A latch assembly releasably secures the frame in the storage position. There is a storage container which is telescopically movable through an open front end of the frame between a retracted position wherein the storage container is substantially disposed within confines of the frame and an extended position wherein a front end of the storage container is disposed a predetermined distance from the open end of the frame.

11 Claims, 7 Drawing Sheets

OVERHEAD STORAGE SYSTEM HAVING TELESCOPIC STORAGE CONTAINER

CROSS-REFERENCE TO RELATED APPLICATIONS

This application is related to and claims priority from Provisional Patent Application Ser. No. 61/053,851 filed on May 16, 2008.

FIELD OF THE INVENTION

The present invention relates, in general, to overhead storage systems and, more particularly, this invention relates to an overhead storage system having a pivotal and telescopic storage container.

BACKGROUND OF THE INVENTION

As is generally well known, finding room to store all of one's belongings, especially between seasons, can be difficult. Items that are commonly stored in boxes under the bed or in a closet can be an eyesore and ruin the entire ambiance of a room. Stacking multiple boxes on shelves leaves the items open to damage from moisture and insects. Use of heavy shelving can be hazardous to children who may climb these shelves or reach for a box and pull the entire unit on themselves. There may also be objects stored in these boxes that parents do not want children to access. Also, depending on the height of the shelf, a person may have to use a ladder in order to reach the boxes. Some individuals may not feel comfortable climbing the ladder. Ascending and descending the ladder may be particularly unsafe for elderly individuals.

Prior to the conception and design of the present invention, efforts have been made to alleviate difficulties of storing objects by utilizing available space at the ceiling of a car garage area or any other portion of a dwelling. U.S. Pat. No. 7,246,865 issued to Merrell, II, U.S. Pat. No. 6,550,878 issued to Nott et al., U.S. Pat. No. 5,954,410 issued to Noellert, U.S. Pat. No. 5,460,280 issued to Feddeler and U.S. Pat. No. 5,407,261 issued to Mercer disclose various types of the overhead storage systems that are either attached to the ceiling surface or are integrated into the suspended ceiling.

However, while these prior art systems fulfill their respective requirements, there is a need for further improvements in overhead storage systems.

SUMMARY OF THE INVENTION

The invention provides an overhead storage system for attachment to a ceiling. The overhead storage system includes a hollow housing. A hollow frame is also provided. There is means for pivotally connecting a rear end of the frame to a rear end of the housing so that the frame pivots between a storage position wherein the frame is disposed generally coplanar with a ceiling surface and an access position wherein the frame is disposed at a predetermined angle relative to the ceiling surface. A latch assembly is also provide and releasably secures the frame in the storage position. There is a storage container which is telescopically movable through an open front end of the frame between a retracted position wherein the storage container is substantially disposed within confines of the frame and an extended position wherein a front end of the storage container is disposed a predetermined distance from the open end of the frame. There is also another latch that releasably secures the storage container in the retracted position. Both latches are adapted to be unlatched with an elongated tool. Means for controlling pivotal movement of the frame and telescopic movement of the storage container are also provided.

OBJECTS OF THE INVENTION

It is, therefore, one of the primary objects of the present invention to provide an overhead storage system having a pivotal and telescopic storage container.

Another object of the present invention is to provide an overhead storage system having a pivotal and telescopic storage container that eliminates use of ladders.

Yet another object of the present invention is to provide an overhead storage system having a pivotal and telescopic storage container that is simple to operate.

A further object of the present invention is to provide an overhead storage system having a pivotal and telescopic storage container that requires minimal effort to operate.

Yet a further object of the present invention is to provide an overhead storage system having a pivotal and telescopic storage container that can be mounted to the ceiling surface or installed between the ceiling structural members.

An additional object of the present invention is to provide an overhead storage system having a pivotal and telescopic storage container that enables the user to adjust the speed of pivotal movement.

Another object of the present invention is to provide An additional object of the present invention is to provide an overhead storage system having a pivotal and telescopic storage container that attenuates extension of the storage container.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
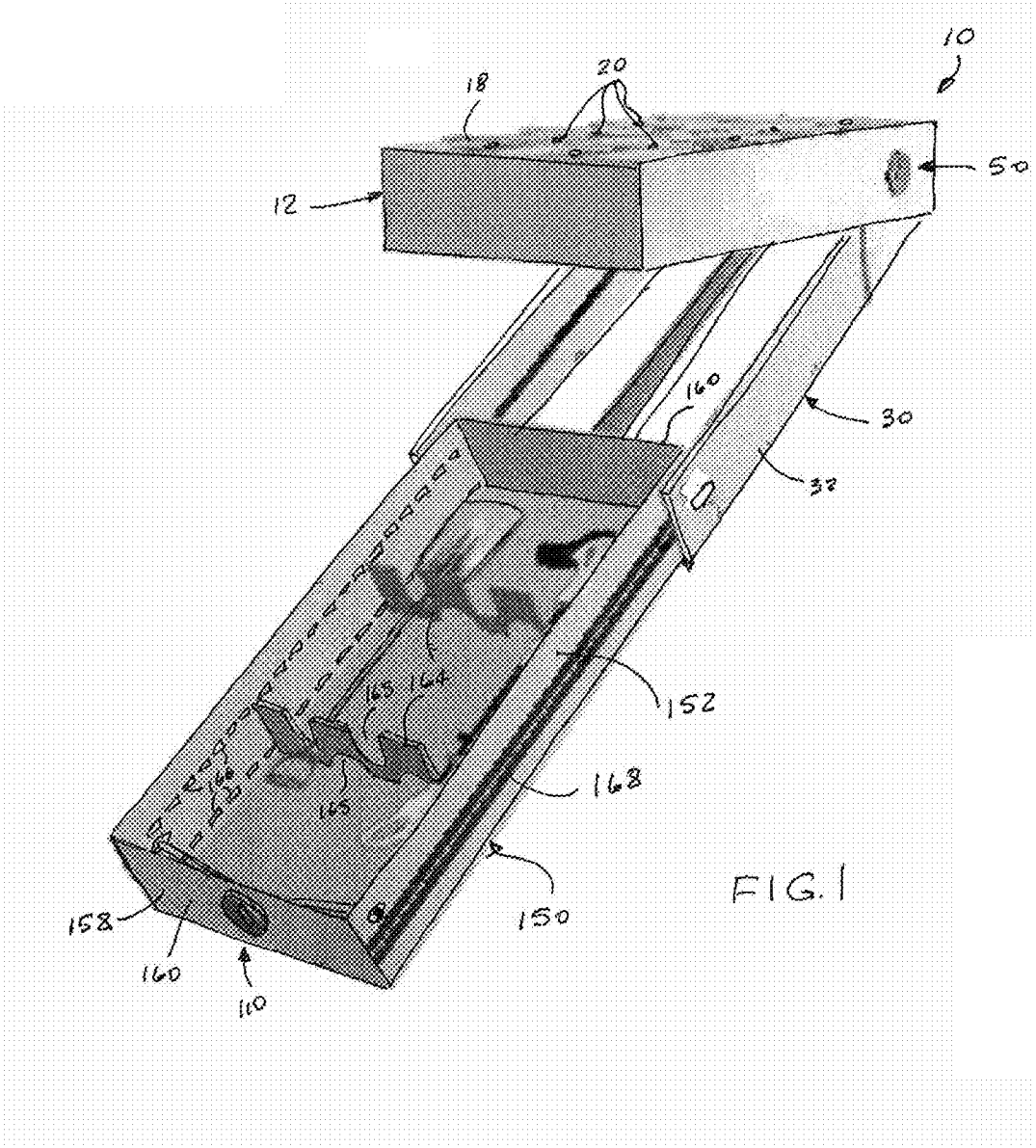
FIG. 1 is an isometric view of the overhead storage system of the present invention, particularly illustrating storage container in the extended access position.
Figure 2:
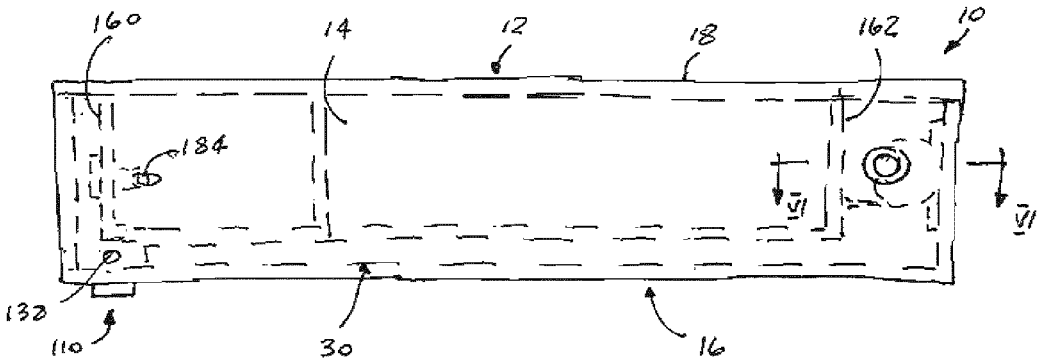
FIG. 2 illustrates a side elevation view of the overhead storage system of FIG. 1.
Figure 3:
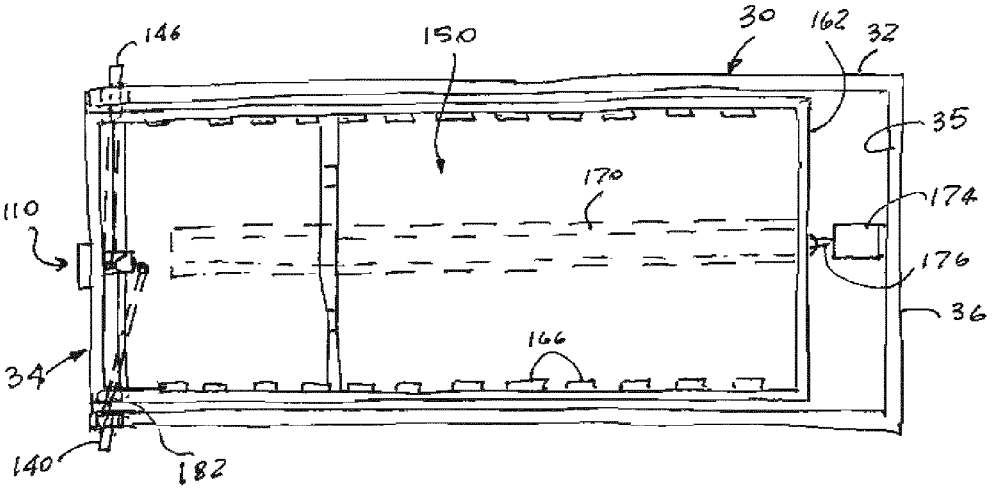
FIG. 3 illustrates a top planar view of the overhead storage system of FIG. 2 with the housing removed for clarity.
Figure 4:
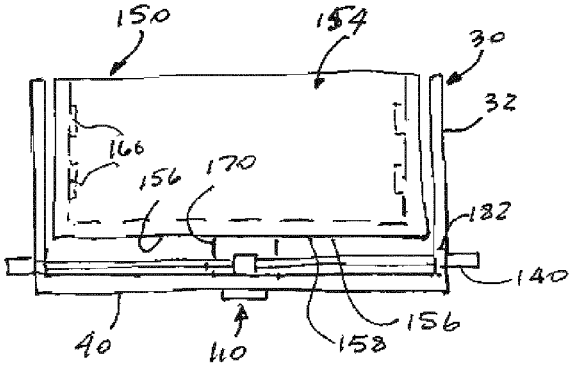
FIG. 4 illustrates a front elevation view of the overhead storage system of FIG. 2.

Prior to proceeding to the more detailed description of the present invention, it should be noted that, for the sake of clarity and understanding, identical components which have identical functions have been identified with identical reference numerals throughout the several views illustrated in the drawing figures.

Now in reference to FIGS. 1-15, therein is illustrated an overhead storage system, generally designated as 10, that is intended to utilize empty available space that is generally available at the ceiling area 2 either below the ceiling surface 4 or above such ceiling surface 4 between the ceiling structural members 6 that are generally disposed in a parallel spaced relationship to each other.

Now in a particular reference to FIGS. 1-4, the overhead storage system 10 includes a generally hollow housing 12 having each of a peripheral side wall 14, an open bottom portion 16 and at least partially closed top portion 18. A predetermined plurality of mounting apertures 20 are formed in a predetermined pattern (that may be of a lattice type) through the at least partially closed top portion 18 so as to enable the housing 12 to be rigidly secured with fasteners (not shown) to the ceiling surface 4. Although the present invention is illustrated and described in combination with the housing 12 having a generally rectangular shape in each of the vertical and horizontal planes, which is preferably when the housing 12 is to be mounted between the structural members 6, other housing shapes are within the scope of the present invention.

The housing 12 may be manufactured from any sturdy materials including wood, steel and plastics, although it is presently preferred to manufacture the at least partially closed top portion 18 from metal material.

A frame 30 is also provided and has each of a U-shaped side wall 32 forming an open front end 34 and a closed rear end 36 of the frame 30, an open top portion 38 and at least partially closed bottom portion 40. Preferably, such bottom portion 40 is completely closed. The frame 30 may be manufactured from any sturdy materials including wood, steel and plastics.

Figure 5:
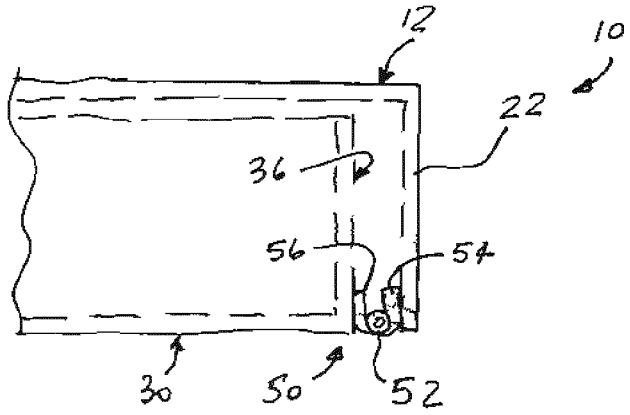
FIG. 5 is a partial side elevation view of the overhead storage system of FIG. 1, particularly illustrating frame pivot arrangement constructed in accordance with one embodiment of the invention.

There is pivoting means, generally designated as 50, for pivotally attaching the rear end 36 of the frame 30 to a rear portion of the housing 12 so that the frame 30 pivots between a storage position wherein the at least partially closed bottom portion 40 of the frame 30 is disposed coplanar with the ceiling surface 4 and an access position wherein the at least partially closed bottom portion 40 of the frame 30 is disposed at a predetermined angle relative to the ceiling surface 4. Such pivoting means 50 may be at least one conventional continuous piano type hinge 52 having a first leg 54 secured to a rear end 22 of the housing 12 and having another 56 leg thereof secured to the rear end 36 of the frame 30, as best shown in FIG. 5.

Figure 6:
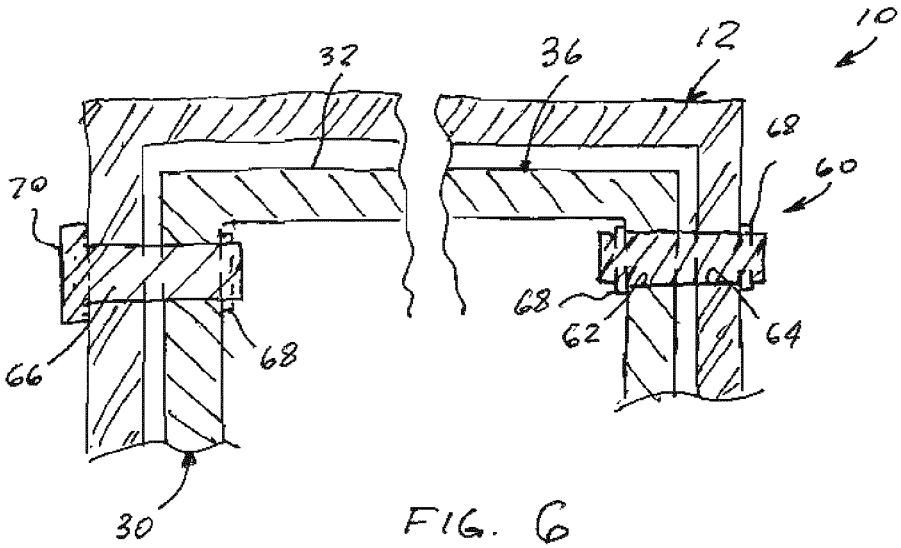
FIG. 6 is a partial cross-sectional view along lines VI-VI of FIG. 2, particularly illustrating frame pivot arrangement constructed in accordance with another embodiment of the invention.
Figure 13:
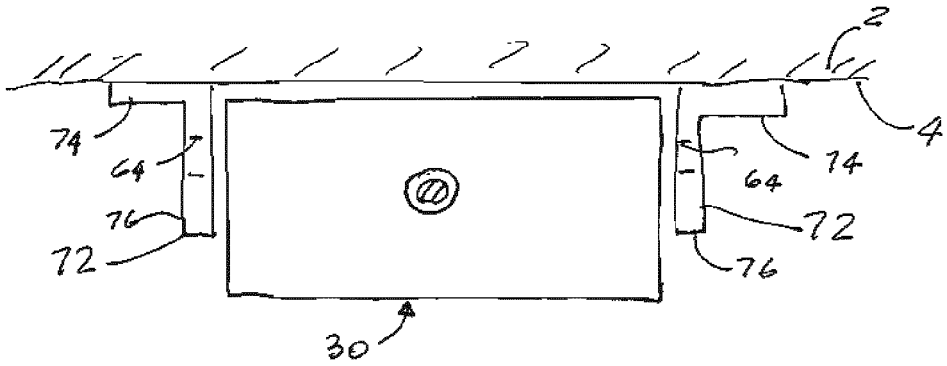
FIG. 13 illustrates mounting of the overhead storage system of FIG. 2 to the ceiling surface.
Figure 7:
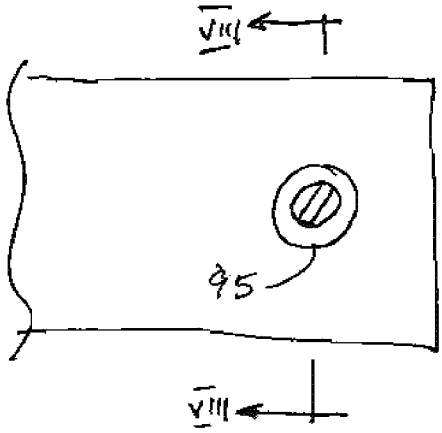
FIG. 7 is a partial side elevation view of the overhead storage system of FIG. 1, particularly illustrating frame pivot arrangement constructed in accordance with a presently preferred embodiment of the invention.
Figure 8:
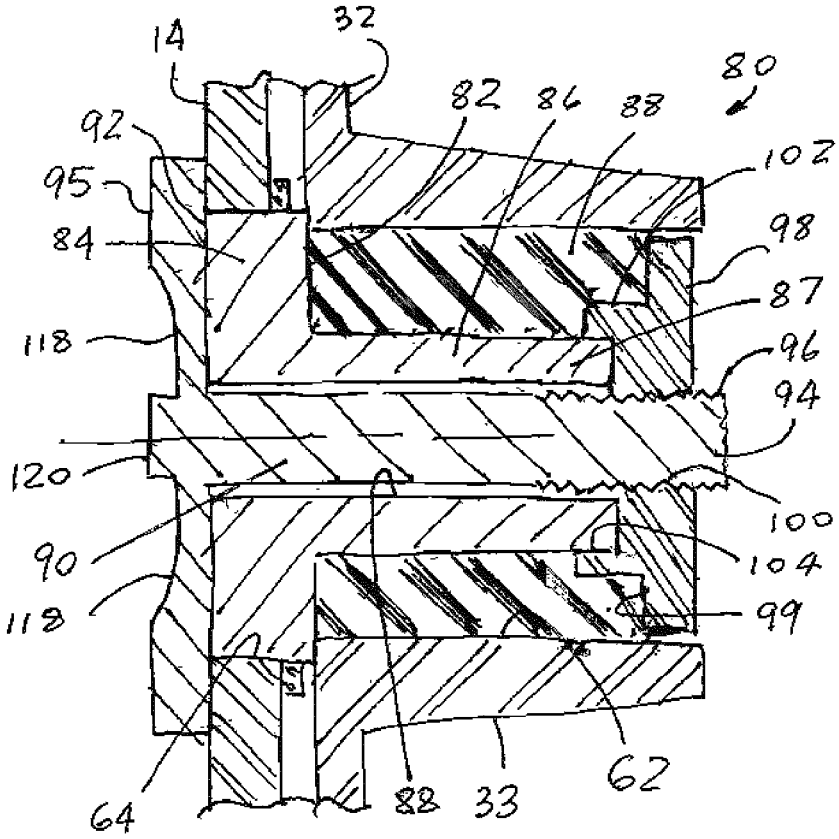
FIG. 8 is a cross-sectional view of the pivot arrangement of FIG. 7.

Now in a particular reference to FIG. 6, the present invention also contemplates that such pivoting means 50 provides a pair of pivots 60, each pivot 60 disposed at a respective side portion of the U-shaped side wall 32 in close proximity to and spaced from the closed rear end 36 of the frame 30. Each pivot 60 may includes a first aperture 62 formed through the side wall 32, a second aperture 64 formed through the side portion of the peripheral side wall 14 of the housing 12 in axial alignment with the first aperture 62 and a pivot pin 66 passed through apertures 62, 64 and sized for pivotal movement therewithin and further inhibited from axial movement by any conventional means, for example such as a pair of retaining rings 68 or a single retaining ring 68 in with a larger pin head 70.

In accordance with a presently preferred embodiment of the invention, there is means, generally designated as 80, for at least controlling speed of a pivotal movement of the frame 30 from the storage position into the access position. By way of one example only of FIGS. 7-8, such means 80 includes the above described aligned apertures 62 and 64. Furthermore, the side wall 32 of the frame 30 includes an abutment 33 that is shown as extending into the interior of the frame 30 but that also can be extending outwardly from the peripheral wall 32. Subsequently, the aperture 62 is also formed through such abutment 33. The pivot pin 66 is adapted with a shoulder 82 providing for a larger diameter pivot portion 84 and a smaller diameter pivot portion 86. The pivot portion 84 is passed through the aperture 64 and the pivot portion 86 is passed through the aperture 62. A generally cylindrical resilient elastomeric member 88 is mounted onto the pivot portion 86 and is sized to generally abut the peripheral surface of the aperture 62. It is important to note that the length of the pivot portion 86 is smaller than the length of the elastomeric member 88. The pivot pin 66 further has an axial bore 88 formed therethrough and, more particularly, formed through the pivot portions 84 and 66. An elongated member 90 is disposed within the bore 88 and has a pair of ends 92 and 94. The internal end of the elongated member 90, referenced with numeral 94, extends into the interior of the frame 30. At least a portion of the elongated member 90 adjacent the internal end 94 has an external thread 96. A disk like member 98 is provided and has a central threaded bore 100 that operatively engages threaded end 94. The inner surface 99 of the disk like member 98 abuttingly engages one end of the elastomeric member 88, which is then effectively caged between the disk like member 98 and the shoulder 82. An anti-rotation means, for example such as an abutment 102 centrally disposed on the inner surface 99 of the disk like member 98 and having a square shaped bore 104 engaging the square (or other non-round) shaped end 87 of the pivot portion 86 are provided to prevent rotation of the disk like member 98. In operation, rotation of the elongated member 90, initiated at its external end 92 in a first direction, causes the disk like member 98 to advance linearly on the threaded end of the elongated member 90 and compress resilient elastomeric member 88 in an axial direction. Since the resilient elastomeric member 88 is caged between the disk like member 98 and the shoulder 82, it is constrained from axial movement and expands radially, increasing friction with the peripheral inner surface of the aperture 62. This increased friction subsequently, reduces the speed at which the frame 30 pivots relative to the housing 12. Rotation of the elongated member 90 in the opposed direction reduces friction with the peripheral surface of the aperture 62, thus increasing the speed at which the frame 30 pivots relative to the housing 12.

Rotation of the elongated member 90 is facilitated by adapting its external end 92 with a flange 95 having an inner surface thereof abutting an outer surface of the peripheral side wall 14.

It will be appreciated that the frame 30 is to be securely latched in the storage position so as to prevent undesirable and unintended movement into the access position. Accordingly, the present invention provides a latch assembly, generally designated as 110. Now in reference to FIGS. 9-10, the latch assembly 110 includes a fitting 112 having a head member 114 with a pair of substantially planar surfaces 116, 118 spaced apart to define a thickness of the head member 114. The surfaces 116, 118 are disposed in a generally horizontal plane when the frame 30 is disposed in the storage position. A lower one of the pair of substantially planar surfaces, referenced with numeral 116, is adapted to receive an end of a user operable tool. The fitting 112 further has an elongated body portion 120 disposed on an upper one of the pair of substantially planar surfaces, referenced with numeral 118, and extending along a vertically disposed axis though an aperture 24 formed through the at least partially closed bottom portion of the frame 30. There is a retaining means for retaining the fitting 112 in a pivotal manner on the at least partially closed bottom portion of the frame 30. Such retaining means may include an annular groove formed in the elongated body portion 120 and an annular retaining ring 124.

Preferably, a torsion spring 130 is disposed on the elongated body portion 120 for biasing the fitting 112 into a latched position. The torsion spring 130 has one end 132 thereof caged on an inner surface of the at least partially closed bottom portion of the frame 30 and has an opposed end 134 thereof caged on the elongated body portion 120 of the fitting 112.

Figure 9:
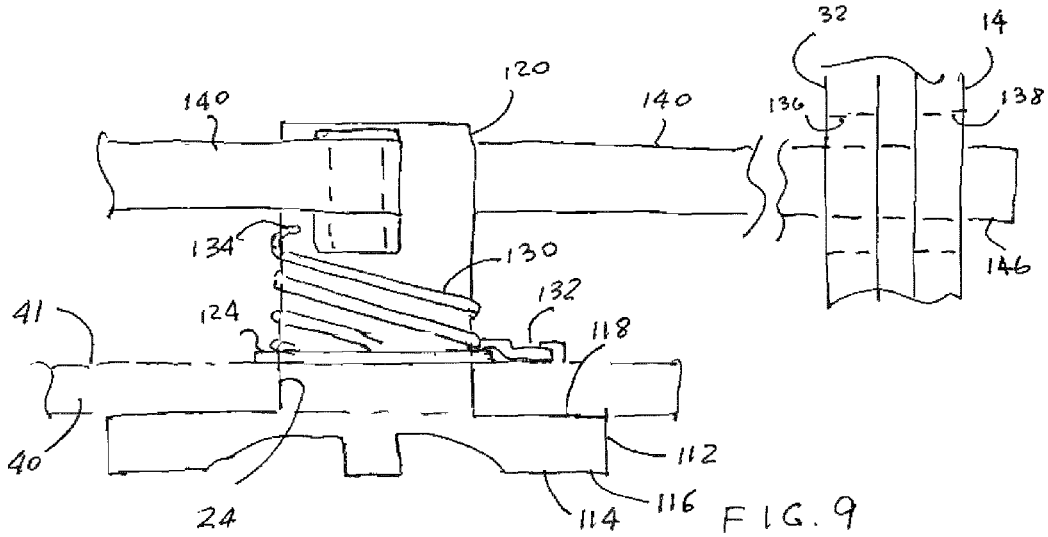
FIG. 9 illustrates elevation view of the presently preferred latch assembly employed within the overhead storage system of FIG. 1.
Figure 10:
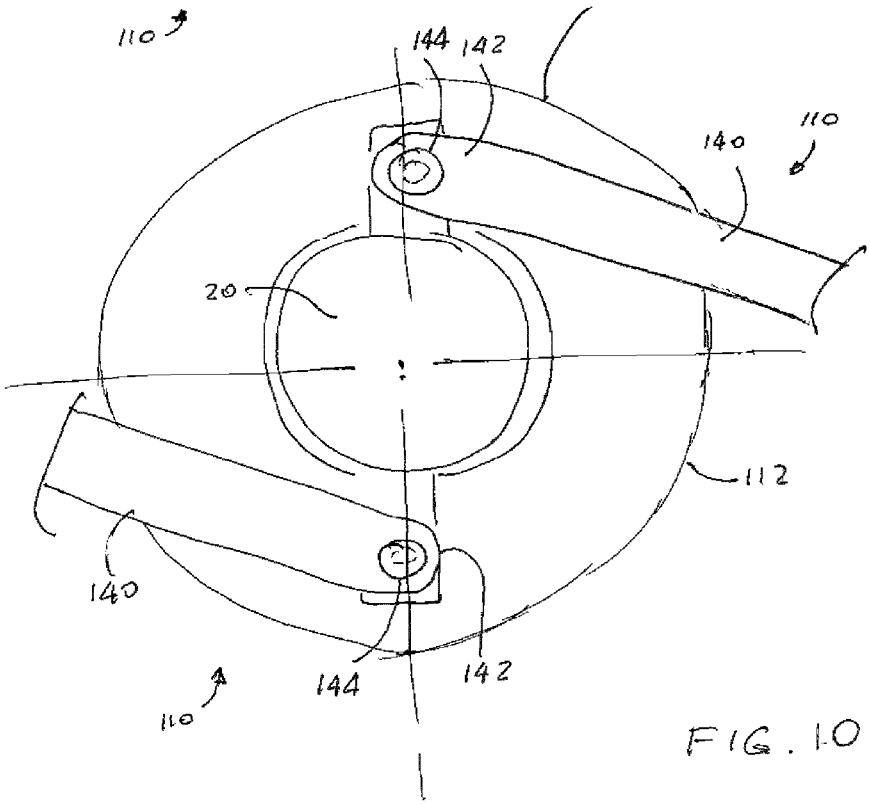
FIG. 10 is a top planar view of the latch assembly of FIG. 9.
Figure 11:
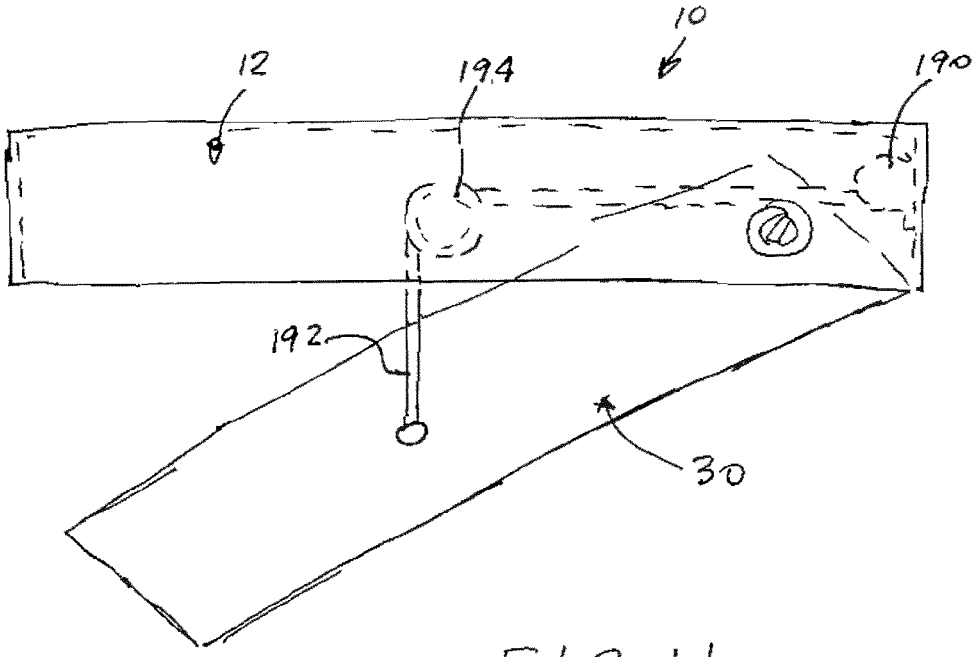
FIG. 11 illustrates frame pivot attenuating arrangement constructed in accordance with one embodiment of the invention.

There is a pair of first apertures 136, only one of which is shown in FIG. 9. Each of the pair of first apertures 136 is formed through a respective side portion of the U-shaped side wall 32 of the frame 30. There is also a pair of second apertures 138, only one of which is shown in FIG. 9. Each of the pair of second apertures 138 is formed through a respective portion of the peripheral side wall 14 of the housing 12 in close proximity to a front end thereof and in axial alignment with a respective one of the pair of first apertures 136.

Finally, the latch assembly 110 includes a pair of linkages 140. Each of the pair of linkages 140 has a proximal end 142 thereof pivotally connected to the elongated body portion 120 at a pivot 144 and has a distal end 146 thereof extending through a respective pair of aligned first and second apertures 136, 138 respectively, when the frame 30 is disposed in the storage position. In operation the user rotates the fitting 112 in one direction to disengage the distal ends 146 from the second apertures 138 thus allowing the frame 30 to pivot downwardly into toward the access position. After initial pivoting of the frame 30, the fitting 112 rotates in an opposed direction due to force from the torsion spring 130.

Now in further reference to FIGS. 1-4, the overhead storage system 10 also provides a storage container, generally designated as 150, having each of a peripheral side wall 152, an open top portion 154 and a closed bottom portion 156. An outer surface 158 of the bottom portion 156 of the storage container 150 is spaced a predetermined distance from an inner surface 41 of the at least partially closed bottom portion 40 of the frame 30. An outer surface 160 of a front portion 158 of the peripheral side wall 152 of the storage container 150 is spaced a predetermined distance from an inner surface of a front portion of the peripheral side wall 14 of the housing 12. Also, an outer surface 162 of a rear portion 160 of the peripheral side wall 152 of the storage container 150 is spaced a predetermined distance from an inner surface 35 of a rear end 36 of the U-shaped side wall 32 of the frame 30.

In a conventional manner, the inner space of the storage container 150 may be divided by dividers 164 and guides 166. At least one divider 164 may be configured with shaped slots or edge notches 165 so as to organize storage of various objects therewithin.

The storage container 150 is adapted for linear telescopic movement relative to the frame 30 through the open front end of the frame 30 between a retracted position wherein the storage container 150 is substantially disposed within confines of the frame 30 and an extended position wherein a front end of the storage container 150 is disposed a predetermined distance from the open front end 34 of the frame 30. The criticality of this telescopic movement is that storage container 150 is positioned in the extended position so as to allow the user of the overhead storage system 10 to access the interior of the storage container 10 without the use of ladders or stepping stools. The storage container 150 may be manufactured from any sturdy materials including wood, steel and plastics.

Such telescopic movement may be facilitated by a pair of side runners 168 provided on the at least partially closed bottom portion 40 or the U-shaped side wall 32 of the frame 30, but preferably, there is at least one linear slide member 170 which is mounted in a space between the outer surface of the bottom portion 156 of the storage container 150 and the inner surface 41 of the at least partially closed bottom portion 40 of the frame 30 and operatively connected thereto. Such at least one linear slide member 170 may be a conventional bearing or roller type linear slide.

In order to attenuate such telescopic movement of the storage container 150 between the retracted and extended positions, there is provided a spring powered cable assembly 174 which is mounted in a space between the outer surface of the rear portion of the peripheral side wall 152 of the storage container 150 and the inner surface of the rear end 36 of the U-shaped frame 30. The spring powered cable assembly 174 has a free end of a cable 176 connected to the rear portion of the peripheral side wall 162 of the storage container 150. The spring powered cable assembly 174 may be of the type as employed for balancing hand tools and sized to withstand the operational rigors of the overhead storage system 10.

To prevent uncontrolled telescopic movement of the storage container 150 into the extended position during downward pivoting of frame 30, the present invention provides another latch assembly securing the storage container 150 in the retracted position. Preferably, for the sake of commonality and cost containment, such latch assembly is identical to the latch assembly 110, except for mounting orientation of its components. Specifically, the fitting 112 is mounted centrally on the front portion of the peripheral side wall 152 with the elongated body portion 120 of the fitting 112 extending, along the horizontal axis when such frame 30 is disposed in stored position, through the aperture 180 formed through such front portion of the peripheral side wall 152. An aperture 182 is formed through side portion of the peripheral side wall 152 in close proximity and spaced from the front end of the storage container 150 and a complimentary aperture 184 is formed through the side portion of the U-shaped side wall 32 of the frame 30 to receive distal end 142 of the linkage member 140.

The present invention also contemplates alternative embodiment of attenuating pivotal movement of the frame 30. By way of an example of FIG. 11, a combination of a spring powered cable assembly 190 and a pulley 194 is installed at each side of the housing 12. The free end of the cable 192 is then attached to the side portion of the U-shaped side wall 32 of the frame 30.

Figure 12:
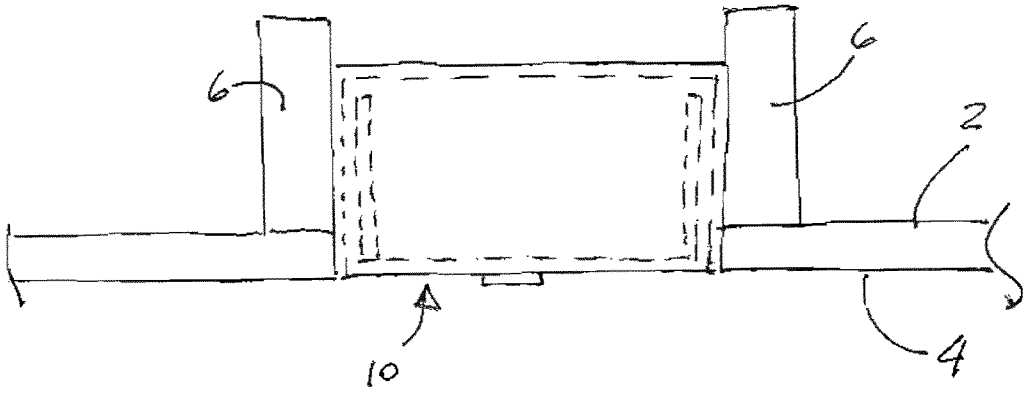
FIG. 12 illustrates mounting of the overhead storage system of FIG. 1 within ceiling structure.
Figure 14:
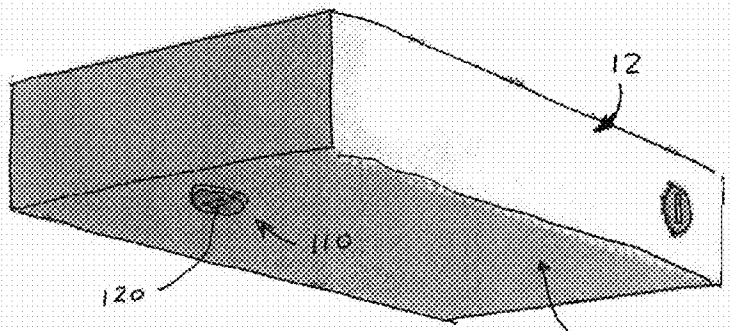
FIG. 14 illustrates an environmental view of using a tool to unlatch the overhead storage system of FIG. 1 for movement into access position.
Figure 14:
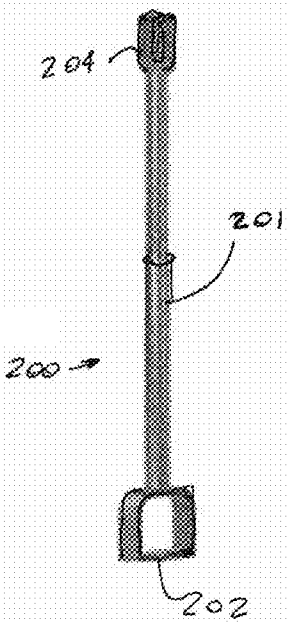
Figure 15:
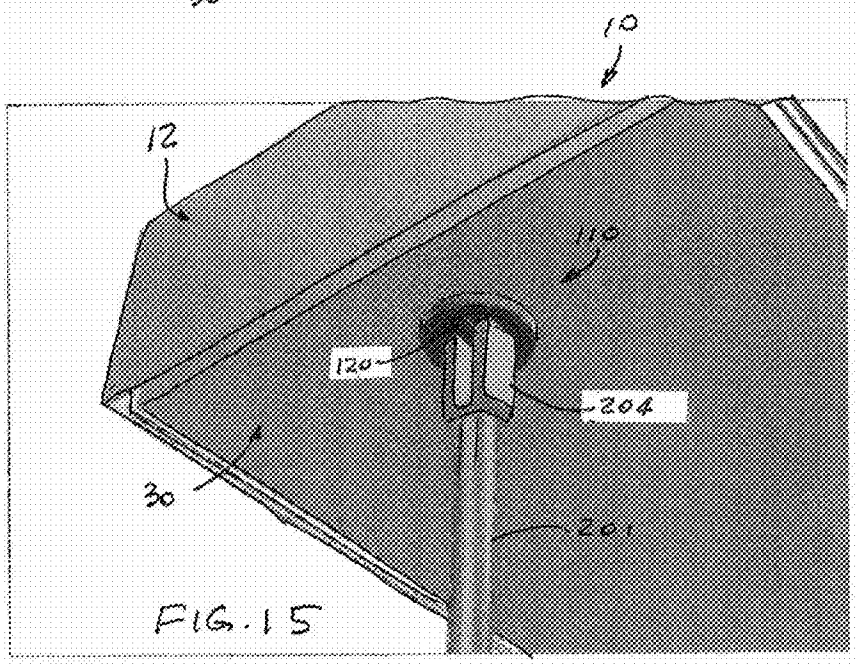
FIG. 15 is a partial enlarged view of the tool coupling of FIG. 14

It is also within the scope of the present invention to pivotally mount the frame 30 directly to the ceiling surface 4 or between the ceiling structural support members 6, as well as mount the housing 12 between the ceiling structural support members 6 so as to position the at least partially closed bottom portion 40 of the frame 30 generally flush with the ceiling surface 4, as best shown in FIG. 12. By way of an example only of FIG. 13, the pivot means may includes a pair of L-shaped brackets 72 each having a first leg 74 thereof attached to the ceiling surface 4 and having a second leg 76 thereof extending downwardly and having the aperture 64 formed therethrough.

To eliminate use of ladders and/or stepping stools when unlatching the frame 30 for movement into access position, there is a tool 200 that has a telescopic portion 201, a handle 202 attached to one end of the telescopic portion 201 and a U-shaped member 204 attached to an opposed end of the telescopic portion 201. The outer surface 116 of the fitting head 112 is then adapted with a pair of recesses 118 forming a bar-shaped portion 120 that is sized to fit within the U-shaped member 204. Thus, the user can simply rotate the first fitting 112 to pivot the frame 30 into the access position and then rotate the second fitting 112 in order to extend the storage container 150. Advantageously, the user can employ the tool 200 to control pivotal movement of the frame 30 and telescopic movement of the storage container 150 as well as aid in pivoting the frame 30 into the storage position.

It is further prefer to adapt the outer surface of the flange 95 with such pair of recesses 118 forming a bar-shaped portion 120 so as to enable the user to adjust speed of pivotal movement of the frame 30 with the tool 200.

While the U-shaped member 204 provides sufficient torque, other mating arrangements are within the scope of the present invention.

The present invention also anticipates that it may be desirable to position such frame 30 at angles less than ninety (90) degrees relative to the ceiling surface 4. Accordingly, a simple stop member (not shown) may be attached to the rear end 34 of the frame 30 and shaped to abut the ceiling surface 4.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. In combination with a ceiling an overhead storage system comprising:

(a) a generally hollow housing having each of a peripheral side wall, an open bottom portion and at least partially closed top portion;

(b) a predetermined plurality of mounting apertures formed in a predetermined pattern through said at least partially closed top portion so as to enable said housing to be rigidly secured with fasteners to a predetermined portion of said ceiling;

(c) a frame;

(d) a pivotal attachment mechanism attaching a rear end of said frame to a rear end of said housing so that said frame pivots between a storage position wherein said frame is disposed generally coplanar with a ceiling surface and an access position wherein said frame is disposed at a predetermined angle relative to said ceiling surface, and wherein said pivotal attachment mechanism includes:

(i) a first aperture formed through a side wall of said frame adjacent to and spaced from a rear end thereof;

(ii) a second aperture formed through a side wall of said housing in axial alignment with said first aperture; and (iii) a pin passed through said each of said first and second apertures;

(e) a latch assembly releaseably securing said frame in said storage position;

(f) a storage container; and (g) a mechanism for controlling speed of a pivotal movement of said frame from said storage position into said access position, said mechanism including:

(i) an abutment disposed on said side wall of said frame, wherein said first aperture is formed through said abutment;

(ii) a shoulder formed in said pin mediate ends thereof, wherein an end portion of said pin has each of a smaller diameter and non-round cross section in a direction transverse to said smaller length;

(iii) an elastomeric resilient member positioned on said end portion within said first aperture, wherein a length of said end portion is smaller than a length of said elastomeric resilient member;

(iv) a bore axially formed through said pin;

(v) an elongated member positioned within said axial bore and having an external thread provided on at least a portion thereof disposed adjacent an inner end;

(vi) a disk shaped member disposed within said first aperture and having one surface thereof abuttingly engaging one end of said elastomeric resilient member, wherein said elastomeric resilient member is caged between said disk shaped member and said shoulder;

(vii) an abutment formed on said one surface of said disk; and (viii) a bore formed in said abutment and sized to fit over said end portion of said pin so as to prevent rotational movement of said disk during rotation of said elongated member, wherein said rotational of said elongated member in one direction causes said disk shaped member to axially compress said elastomeric resilient member increasing friction between an outer surface thereof and a peripheral inner surface of said first aperture, said increased friction reducing pivotal speed of said frame, and wherein rotation of said elongated member in an opposed direction causes said disk to relive said compression of said elastomeric resilient member decreasing said friction between said outer surface thereof and said inner peripheral surface of said first aperture.

2. The apparatus, according to claim 1, wherein said pivotal attachment mechanism for attaching said rear end of said frame to said frames includes at least one hinge member having one leg thereof secured to said rear end of said frame and having an opposed leg thereof secured with fasteners to a predetermined inner surface of said frame.

3. The apparatus, according to claim 1, wherein said apparatus includes means for telescopically moving said storage container through an open front end of said frame between a retracted position wherein said storage container is substantially disposed within confines of said frame and an extended position wherein a front end of said storage container is disposed a predetermined distance from said open end of said frame.

4. The apparatus, according to claim 3, wherein said apparatus includes means for attenuating said telescopic movement of said storage container.

5. The apparatus, according to claim 4, wherein said telescopic movement attenuating means includes a spring powered cable assembly mounted in a space between a rear end of said storage container and a rear end of said frame and having a free end of a cable connected to said rear end of said storage container, said spring powered cable assembly attenuating said telescopic movement of said storage container between said retracted and extended positions.

6. The apparatus, according to claim 3, wherein said apparatus includes means for facilitating said telescopic movement of said storage container.

7. The apparatus, according to claim 6, wherein said telescopic movement facilitating means includes a linear slide disposed in a space between a bottom exterior surface of said storage container and an interior surface of a bottom portion of said frame.

8. The apparatus, according to claim 1, wherein said apparatus includes means engageable with an outer end of said elongated member for facilitating rotation thereof.

9. The apparatus, according to claim 8, wherein said rotation facilitating means includes a flange disposed on said outer end of said elongated member in a plane transverse to a length thereof, a pair of recesses formed in outer surface of said flange and providing a bar-shaped portion for engagement with a user operable tool.

10. The apparatus, according to claim 9, wherein said apparatus further includes said user operable tool having a telescopic member, a handle attached to one end of said telescopic members and a U-shaped member attached to an opposed end of said telescopic members and sized to receive said bar-shaped portion therewithin.

11. In combination with a ceiling surface an overhead storage system comprising:

a) a generally hollow housing having each of a peripheral side wall, an open bottom portion and at least partially closed top portion;

b) a predetermined plurality of mounting apertures formed in a predetermined pattern through said at least partially closed top portion so as to enable said housing to be rigidly secured with fasteners to said ceiling surface;

c) a frame having each of a U-shaped side wall forming an open front end of said frame, an open top portion and at least partially closed bottom portion;

(d) at least one hinge pivotally attaching a rear end of said frame to a rear portion of said housing so that said frame pivots between a storage position wherein said at least partially closed bottom portion of said frame is disposed coplanar with said ceiling surface and an access position wherein said at least partially closed bottom portion of said frame is disposed at a predetermined angle relative to said ceiling surface;

(e) an abutment disposed on each said side wall of said frame adjacent to and spaced from a rear end thereof;

(f) a first pivot aperture formed through each abutment;

(g) a second pivot aperture formed through each side portion of said peripheral side wall of said housing in axial alignment with said first pivot aperture;

(h) a pin passed through a respective pair of said first and second pivot apertures;

(i) a shoulder formed in said pin mediate ends thereof, wherein an end portion of said pin has each of a smaller diameter and non-round cross section in a direction transverse to said smaller length;

(j) an elastomeric resilient member positioned on said end portion within said first aperture, wherein a length of said end portion is smaller than a length of said elastomeric resilient member;

(k) a bore axially formed through said pin;

(l) an elongated member positioned within said axial bore and having an external thread provided on at least a portion thereof disposed adjacent an inner end;

(m) a disk shaped member disposed within said first aperture and having one surface thereof abuttingly engaging one end of said elastomeric resilient member, wherein said elastomeric resilient member is caged between said disk shaped member and said shoulder;

(n) an abutment formed on said one surface of said disk shaped member;

(o) a bore formed in said abutment and sized to fit over said end portion of said pin so as to prevent rotational movement of said disk shaped member during rotation of said elongated member, wherein said rotational of said elongated member in one direction causes said disk shaped member to axially compress said elastomeric resilient member increasing friction between an outer surface thereof and a peripheral inner surface of said first aperture, said increased friction reducing pivotal speed of said frame, and wherein rotation of said elongated member in an opposed direction causes said disk shaped member to relieve said compression of said elastomeric resilient member decreasing said friction between said outer surface thereof and said inner peripheral surface of said first aperture;

(p) means for terminating said pivotal movement of said frame in said access position at said predetermined angle;

(q) a first latch assembly releaseably securing said frame in said storage position, said first latch assembly including:

(i) a first fitting having a first head member with a pair of substantially planar surfaces spaced apart to define a thickness of said first head member and disposed in a generally horizontal plane when said frame is disposed in said storage position, wherein a lower one of said pair of substantially planar surfaces adapted to receive an end of a user operable tool, said first fitting further having a first elongated body portion disposed on an upper one of said pair of substantially planar surfaces and extending along a vertically disposed axis though an aperture formed through said at least partially closed bottom portion of said frame, (ii) a first retaining means for retaining said first fitting in a pivotal manner on said at least partially closed bottom portion of said frame, (iii) a first torsion spring disposed on said first elongated body portion for biasing said first fitting into a latched position, said first torsion spring having one end thereof caged on an inner surface of said at least partially closed bottom portion of said frame and having an opposed end caged on said elongated body portion of said first fitting, (iv) a pair of first apertures, each of said pair of first apertures formed through a respective side portion of said U-shaped side wall of said frame, a pair of second apertures, each of said pair of second apertures formed through a respective portion of said peripheral side wall of said housing in close proximity to a front end thereof and in alignment with a respective one of said pair of first apertures, and (v) a pair of first linkages, each of said pair of first linkages having a proximal end thereof pivotally connected to said first elongated body portion and having a distal end thereof extending through a respective pair of aligned first and second apertures when said frame is disposed in said storage position;

(r) a storage container having each of a peripheral side wall, an open top portion and a closed bottom portion, wherein an outer surface of said bottom portion of said storage container is spaced a predetermined distance from an inner surface of said at least partially closed bottom portion of said frame, wherein an outer surface of a front portion of said peripheral side wall of said storage container is spaced a predetermined distance from an inner surface of a front portion of said peripheral side wall of said housing, and wherein an outer surface of a rear portion of said peripheral side wall of said storage container is spaced a predetermined distance from an inner surface of a rear portion of said U-shaped side wall of said frame;

(s) at least one linear slide member mounted in a space between said outer surface of said bottom portion of said storage container and said inner surface of said at least partially closed bottom portion of said frame and operatively connected thereto, said at least one linear slide member facilitating telescopic movement of said storage container through said open front end of said frame between a retracted position wherein said storage container is substantially disposed within confines of said frame and an extended position wherein a front end of said storage container is disposed a predetermined distance from said open end of said frame;

(t) a spring powered cable assembly mounted in a space between said outer surface of said rear portion of said peripheral side wall of said storage container and said inner surface of said rear portion of U-shaped side wall and having a free end of a cable connected to said rear portion of said peripheral side wall of said storage container, said spring powered cable assembly attenuating said telescopic movement of said storage container between said retracted and extended positions; and (u) a second latch assembly releaseably securing said storage container in said retracted position, said second latch assembly including:

(i) a second fitting having a second head member with a pair of substantially planar surfaces spaced apart to define a thickness of said second head member and disposed in a generally vertical plane when said frame disposed in said storage position, wherein an outer one of said pair of substantially planar surfaces of said second head member adapted to receive said end of said user operable tool, said second fitting further having a second elongated body portion disposed on an inner one of said pair of substantially planar surfaces of said second head of said second fitting and extending though an aperture formed through said front portion of said peripheral side wall of said storage container along a horizontally disposed axis, (ii) a second retaining means for retaining said second fitting in a pivotal manner on said front portion of said peripheral side wall of said storage container, (iii) a second torsion spring disposed on said second elongated body portion for biasing said second fitting into a latched position, said second torsion spring having one end thereof caged on an inner surface of said front portion of said peripheral side wall of said storage container and having an opposed end caged on said second elongated body portion of said second fitting, (iv) a pair of third apertures, each of said pair of third apertures formed through a respective side portion of said peripheral side wall of said storage container, (v) a pair of forth apertures, each of said pair of second apertures formed through said respective side portion of said U-shaped side wall of said frame in close proximity to a front end thereof and in alignment with a respective one of said pair of third apertures, and (vi) a pair of second linkages, each of said pair of second linkages having a proximal end thereof pivotally connected to said second elongated body portion and having a distal end thereof extending through a respective pair of aligned third and forth apertures when said storage container is disposed in said retracted position.

* * * * *